US007856196B2

(12) United States Patent
Sakamoto et al.

(10) Patent No.: US 7,856,196 B2
(45) Date of Patent: Dec. 21, 2010

(54) DEVELOPING HOUSING AND CONVEYING DEVICE AND IMAGE FORMING APPARATUS HAVING THE SAME

(75) Inventors: Takashi Sakamoto, Ebina (JP); Naoya Iwata, Hadano (JP); Yuya Kato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 320 days.

(21) Appl. No.: 12/109,478

(22) Filed: Apr. 25, 2008

(65) Prior Publication Data

US 2009/0103952 A1 Apr. 23, 2009

(30) Foreign Application Priority Data

Oct. 17, 2007 (JP) ..... 2007-270067

(51) Int. Cl.
*G03G 15/08* (2006.01)

(52) U.S. Cl. ..... 399/254; 399/255; 399/256

(58) Field of Classification Search ..... 399/254–256
See application file for complete search history.

(56) References Cited

U.S. PATENT DOCUMENTS

2004/0179865 A1* 9/2004 Nishiyama ..... 399/254
2006/0029431 A1* 2/2006 Tanaka et al. ..... 399/254
2006/0204283 A1* 9/2006 Yasuda ..... 399/254

FOREIGN PATENT DOCUMENTS

| | | | |
|---|---|---|---|
| JP | 4-29273 | A | 1/1992 |
| JP | 5-188834 | A | 7/1993 |
| JP | 11-24382 | A | 1/1999 |
| JP | 11-30913 | A | 2/1999 |
| JP | 3070414 | U | 8/2000 |
| JP | 2002-148916 | A | 5/2002 |

OTHER PUBLICATIONS

Notification of Reason for Refusal issued in counterpart Japanese Patent Application No. 2007-270067 dated Dec. 22, 2009.

* cited by examiner

*Primary Examiner*—David M Gray
*Assistant Examiner*—G. M. Hyder
(74) *Attorney, Agent, or Firm*—Sughrue Mion, PLLC

(57) ABSTRACT

A developing device includes a developer holding member that carries a developer; an upper developer housing section that houses the developer; a lower developer housing section that has a bottom surface lower than a bottom surface of the upper developer housing section and houses the developer; a toner supply section that includes an upper toner supply part, a lower toner supply part, and a toner transport section; an upper conveying section that includes a rotation shaft, a first conveying member, a second conveying member, and a diameter direction conveying part; and a lower conveying section that conveys at least one of the developer and the toner in a direction opposite to the conveying direction by the first conveying member.

7 Claims, 6 Drawing Sheets

DEVELOPING HOUSING AND CONVEYING DEVICE AND IMAGE FORMING APPARATUS HAVING THE SAME

CROSS-REFERENCE TO RELATED APPLICATIONS

This application is based on and claims priority under 35 USC 119 from Japanese Patent Application No. 2007-270067 filed on Oct. 17, 2007.

BACKGROUND

1. Technical Field

The present invention relates to a developing device and an image forming apparatus.

2. Related Art

Generally, in image forming apparatuses using an electronic photographing method or an electrostatic recording method, a developing device that develops an electrostatic latent image formed on an electrostatic latent image carrier such as a photosensitive drum is used. As such developing devices, for example, so-called two-component developing-type developing devices in which two-component developer (hereinafter, simply referred to as a developer) including a carrier having magnetism and toner having a resin as its primary component are housed in a developing housing having a developing opening facing the electrostatic latent image carrier, a developer holding member (for example, a developing roll) is disposed in a spot facing the developing opening of the developing housing, and an auger that conveys the developer inside the developing housing to a developing roll while agitating and conveying the developer is disposed on the rear side of the developing roll have been widely used.

In the image forming apparatuses using the developing device of the two-component developing type, toner is consumed at a time when an electrostatic latent image formed on a photosensitive drum is developed by the developing device, and accordingly, the toner is required to be supplied at a predetermined timing.

SUMMARY

According to an aspect of the present invention, there is provided a developer holding member that carries a developer comprising a carrier and a toner; an upper developer housing section that houses the developer to be supplied to the developer holding member; a lower developer housing section that is adjacent to the upper developer housing section; has a bottom surface lower than a bottom surface of the upper developer housing section in a direction of gravitational force; and houses the developer to be supplied to the upper developer housing section; a toner supply section that comprises: an upper toner supply part that is disposed in one end of a shaft of the upper developer housing section; and defines a toner supply opening on an upper side thereof, the toner being supplied from the toner supply opening into the upper toner supply part; a lower toner supply part that is disposed in one end of a shaft of the lower developer housing section, which is the same side as the one end of the shaft of the upper developer housing section; and supplies the toner to the lower developer housing section; and a toner transport section that transports the toner from the upper toner supply part to the lower toner supply part; an upper conveying section that is disposed to extend over the upper developer housing section and the upper toner supply part; and comprises: a rotation shaft; a first conveying member that conveys at least one of the developer and the toner in a shaft direction of the rotation shaft; a second conveying member that is disposed on an end portion on a downstream side in a conveying direction of at least one of the developer and the toner by the first conveying member; and conveys at least one of the developer and the toner in a direction opposite to the conveying direction by the first conveying direction; and a diameter direction conveying part that is disposed in an area corresponding to the toner transport section in the shaft direction of the rotation shaft; and conveys the supplemental toner by applying a conveying force to the supplemental toner, the conveying force being larger in the diameter direction larger than in the shaft direction of the rotation shaft of the upper conveying section; and a lower conveying section that is disposed to extend over the lower developer housing section and the lower toner supply part; rotates such a manner that the lower conveying section passes a bottom side of the lower developer housing section, a side of the upper developer housing section and an upper side of the lower developer housing section in this order; and thereby conveys at least one of the developer and the supplemental toner in a direction opposite to the conveying direction by the first conveying member.

BRIEF DESCRIPTION OF THE DRAWINGS

Exemplary embodiment(s) of the present invention will be described in detail based on the following figures, wherein.

DETAILED DESCRIPTION

Hereinafter, an embodiment of the present invention will be described.

[Overview of Image Forming Apparatus]

Figure 1:
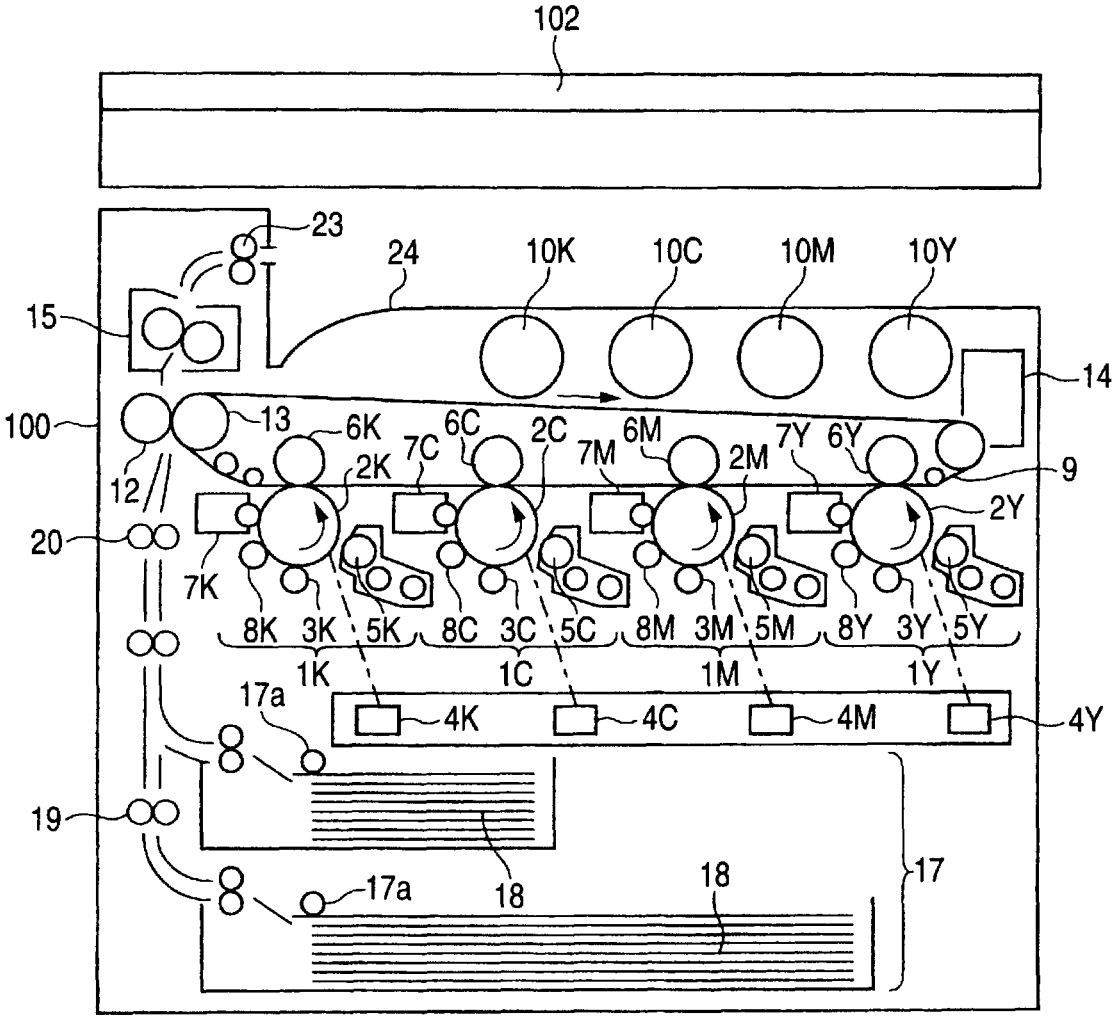
FIG. 1 is a diagram showing a schematic configuration of an image forming apparatus according to an embodiment of the present invention.

First, a schematic configuration of an image forming apparatus according to an embodiment of the present invention will be described with reference to FIG. 1. FIG. 1 is a diagram showing a schematic configuration of a tandem-type color image forming apparatus 100 according to an embodiment of the invention.

To this image forming apparatus 100, color image information of a color document read out by an image reading device 102, color image information transmitted from a personal computer, an image data input device, or the like which is not shown in the figure, and the like are input. The image forming apparatus 100 is configured to perform an image process for the input image information.

In FIG. 1, 1Y, 1M, 1C, and 1K are image forming units that form toner images for colors of yellow (Y), magenta (M), cyan (C), and black (K) and are disposed in series in the order of 1Y, 1M, 1C, and 1K along the moving direction of an endless-shaped intermediate transfer belt 9 suspended on a plurality of suspension rolls. In addition, the intermediate transfer belt 9 is inserted between primary transfer belts 6Y, 6M, 6C, and 6K that are intermediate transfer bodies, onto which toner images of each color orderly formed by the image forming units 1Y, 1M, 1C, and 1K are transferred in a state overlapped with one another, and are disposed to face photosensitive drums 2Y, 2M, 2C, and 2K that are electrostatic latent image carriers corresponding to the image forming units 1Y, 1M, 1C, and 1K, and is formed to be cyclically movable in the direction of the arrow. The toner images of each color transferred in several layers onto the intermediate transfer belt 9 are transferred in aggregate onto a recording sheet 18 serving as a recording medium fed by a paper feed cassette 17 or the like, fixed on the recording sheet 18 by a fixing device 15, and the recording sheet 18 on which a color image is formed is configured to be discharged outside.

Here, the image reading device 102 is configured to illuminate the document placed on a platen glass by using a light source not shown in the figure and read out an image reflected from the document through a scanning optical system with a predetermined resolution by using an image reading component constituted by a CCD sensor or the like.

The image forming units 1Y, 1M, 1C, and 1K has a same configuration. Basically, the image forming units 1Y, 1M, 1C, and 1K include photosensitive drums 2Y, 2M, 2C, and 2K which rotate at a predetermined rotation speed along directions of arrows, charging rolls 3Y, 3M, 3C, and 3K serving as a charging unit for uniformly charging surfaces of the photosensitive drums 2Y, 2M, 2C, and 2K, exposure devices 4Y, 4M, 4C, and 4K which form electrostatic latent images by exposing images corresponding to each color on the surfaces of the photosensitive drums 2Y, 2M, 2C, and 2K, developing devices 5Y, 5M, 5C, and 5K which develop the electrostatic latent images formed on the photosensitive drums 2Y, 2M, 2C, and 2K, toner cartridges 10Y, 10M, 10C, and 10K which are detachably attached and supplemental toners of predetermined colors to the developing devices 5Y, 5M, 5C, and 5K, drum cleaning devices 7Y, 7M, 7C, and 7K, and the like.

According to this embodiment, in the photosensitive drums 2Y, 2M, 2C, and 2K, photosensitive layers made of an organic photosensitive material, an amorphous selenium-based photosensitive material, an amorphous silicon-based photosensitive material, or the like are formed on the surfaces of drums made of a metal material which rotate in the direction of the arrows, and the charging rolls 3Y, 3M, 3C, and 3K are brought into contact with the surfaces of the photosensitive drums 2Y, 2M, 2C, and 2K so as to charge the photosensitive layers to have a predetermined electric potential.

An image forming process in the image forming apparatus having the above-described configuration for a case where the image forming unit 1Y forms a yellow toner image will be described as a representative example.

First, the surface of the photosensitive drum 2Y is charged uniformly by the charging roll 3Y. Next, scanning exposure corresponding to a yellow image is performed by a laser beam output from the exposure device 4Y, for example, based on the image information read out by the image reading device 102, and thereby an electrostatic latent image corresponding to the yellow image is formed on the surface of the photosensitive drum 2Y.

The electrostatic latent image corresponding to this yellow image is formed as a yellow toner image by the developing device 5Y and is transferred primarily on the intermediate transfer belt 9 depending on a pressure contact force and an electrostatic attraction force of the primary transfer roll 6Y constituting a part of the primary transfer unit. Yellow toners remaining on the photosensitive drum 2Y after the primary transfer are scraped out by the drum cleaning device 7Y. Thereafter, the surface of the photosensitive drum 2Y is electrically neutralized by a neutralization device 8Y and then, charged again by the charging roll 3Y for the next image forming cycle.

According to the image forming apparatus 100 forming a multiple color image, the above-described image forming process is performed in image forming units 1M, 1C, and 1K at timings in consideration of relative positional differences of the image forming units 1Y, 1M, 1C, and 1K, and a full-color toner image is formed on the intermediate transfer belt 9 in an overlapped state. As the intermediate transfer belt 9, for example, a belt that is formed in an endless shape by forming a synthetic resin film such as polyimide having flexibility in a band shape and connecting both ends of the synthetic resin film formed in the band shape in the longitudinal direction together by a welding means or the like may be used.

The full-color toner image that has been primarily transferred on the intermediate transfer belt 9 is secondarily transferred on the recording sheet 18 that is conveyed to a secondary transfer position at a predetermined timing depending on a pressure contact force and an electrostatic attraction force between a backup roll 13 supporting the intermediate transfer belt 9 and a secondary transfer roll 12 that is pressingly contacted with the backup roll 13 at a predetermined timing. The remaining toners on the intermediate transfer belt 9 which could not be secondarily transferred on the recording sheet 18 are conveyed to the belt cleaning device 14 in a state of being attached on the intermediate transfer belt 9 and removed from the intermediate transfer belt 9 by the belt cleaning device 14, and thereby a next image forming process is prepared.

The recording sheet 18 of a predetermined size is fed from a paper feed cassette 17 serving as a recording sheet accommodation unit, which is disposed in a lower portion of the image forming apparatus 100, by a paper feed roll 17*a*. The fed recording sheet 18 is conveyed to a secondary transfer position of the intermediate transfer belt 9 at a predetermined timing by a plurality of conveying rolls 19 and resist rolls 20. On the recording sheet 18, as described above, a full-color toner image is transferred in aggregate from the intermediate transfer belt 9 by the backup roll 13 and the secondary transfer roll 12 serving as a secondary transfer unit.

The recording sheet 18 on which the full-color toner image is secondarily transferred from the intermediate transfer belt 9 is separated from the intermediate transfer belt 9 and then is conveyed to the fixing device 15 that is disposed on the down stream side of the secondary transfer unit. Then, the toner image is configured to be fixed on the recording sheet 18 depending on heat and pressure by this fixing device 15. The recording sheet 18 after the fixing process is discharged on a discharge tray 24 through a discharge roll 23.

[Developing Device]

Figure 2:
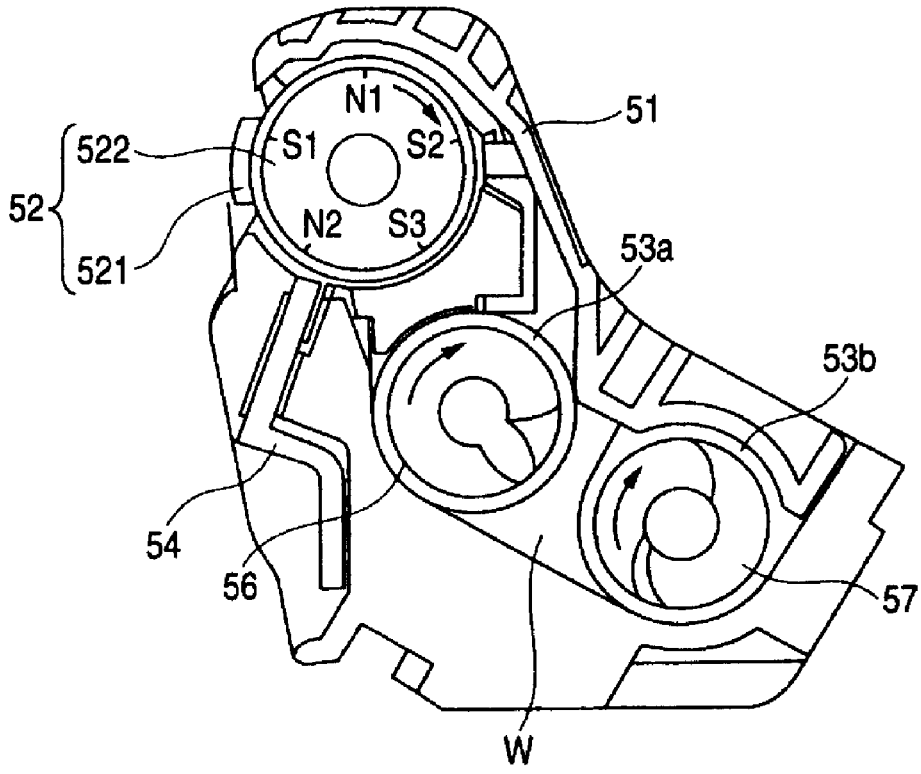
FIG. 2 is a schematic diagram showing the configuration of a developing device according to an embodiment of the present invention.
Figure 3:
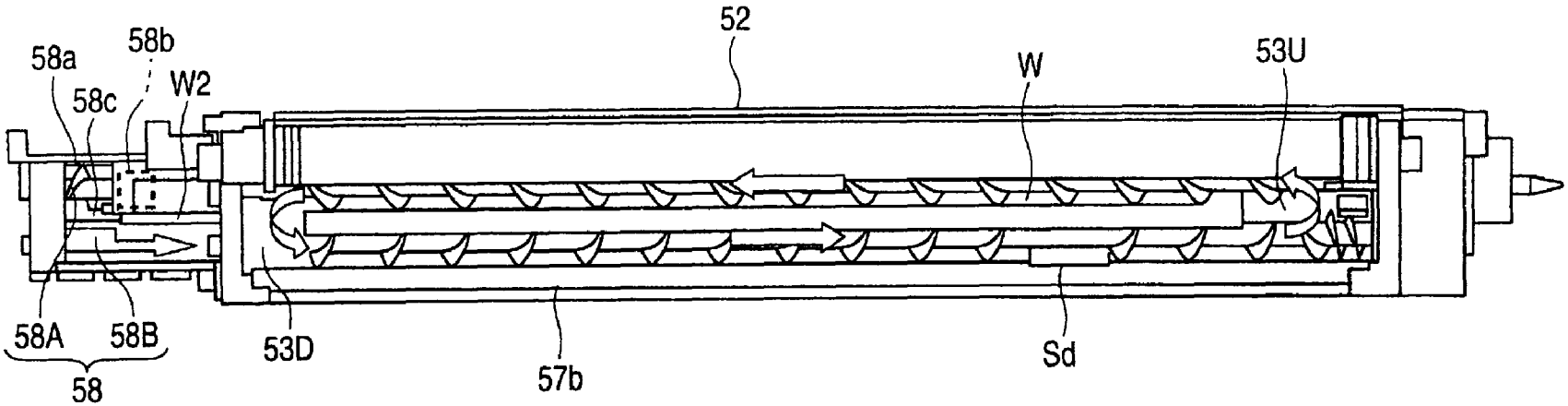
FIG. 3 is a schematic plan view for describing the configuration of a flow path of a developing device according to an embodiment of the present invention.

Next, the configuration of a developing device according to an embodiment of the present invention will be described with reference to FIGS. 2 and 3. Here, FIG. 2 is a schematic diagram showing the configuration of a developing device according to an embodiment of the present invention, and FIG. 3 is a schematic plan view for describing the configuration of a flow path of a developing device according to an embodiment of the present invention. The developing devices 5Y, 5M, 5C, and 5K and constituent members thereof have same configurations. For the simplification of a description, hereinafter each reference sign is represented by a common representation (for example, a developing device 5).

As shown in FIG. 2, a developing device 5 according to this embodiment includes a developing housing 51 that has a portion facing the photosensitive drum 2 opened and houses the two-component developer. A developing roll 52 that is a developer holding member is disposed to face the opening of the developing housing 51. In addition, in a portion, which is adjacent to the developing roll 52, of the developing housing 51, an upper developer housing chamber 53*a* as an example of an upper developer housing section that houses the two-component developer to be able to be supplied to the developing roll 51 and a lower developer housing chamber 53*b* as an example of a lower developer housing section having a lower side adjacently disposed on the right side positioned lower than that of the upper developer housing chamber 53*a* as an example of a lower developer housing section that houses the two-component developer to be able to be supplied to the upper developer housing chamber 53*a* are included. The upper developer housing chamber 53*a* and the lower developer housing chamber 53*b* are partitioned by a partition wall W and communicate with each other in both end portions in the shaft direction. In each of the upper developer housing chamber 53*a* and the lower developer housing chamber 53*b* according to this embodiment has a space for housing the two-component developer. In the upper developer housing chamber 53*a*, a spiral-shaped supply auger 56 that is an upper conveying section for conveying the two-component developer in a predetermined shaft direction (for example, from the inner side to the front side in the figure) is disposed. In the lower developer housing chamber 53*b*, a spiral-shaped admix auger 57 that is a lower conveying section for conveying the two-component developer in a direction (for example, from the front side to the inner side in FIG. 2) opposite to that of the supply auger 56 is disposed.

According to this embodiment, the developing roll 52 includes a developing sleeve 521 that rotates in a predetermined direction (in this example, the clockwise direction) in a developing process and a magnet roll 522 that is installed to be fixed inside this developing sleeve 521.

Here, the developing sleeve 521 is disposed to rotate in a predetermined direction and to face the photosensitive drum 2 with a predetermined distance maintained therebetween in an opening portion of the developing housing 51. To this developing sleeve 521, a bias power source (not shown) for applying a developing bias formed by a DC bias that is generated by superposing alternating currents is connected.

The magnet roll 522 according to this embodiment is formed in a roll shape by disposing a plurality of magnet members in a circumferential direction. The magnet roll 522 includes conveying magnetic poles N1 or pickup magnetic poles S2 which are disposed on the downstream side of the developing magnetic pole S1, for example, with a predetermined angular intervals therebetween and trimming magnetic poles N2 or pickup magnetic poles S3 on the upstream side of the developing magnetic pole S1, along the developing magnetic pole S1 and the rotation direction of the developing roll 52 which are disposed in correspondence with developing areas. The disposition or the number of magnetic poles inside the magnet roll 522 may be appropriately selected.

In addition, below the trimming magnetic pole N2 disposed inside the developing roll 52, a layer-thickness regulation member 54 of an approximate "<" shape which extends along the direction of the shaft of the developing roll 52 such that the facing side of the layer-thickness regulation member closely approaches the developing roll 52 with a predetermined gap is disposed, and is configured to regulate the two-component developer on the developing roll 52 at a predetermined amount (layer thickness).

As clearly shown in FIG. 3, according to this embodiment, on the surface of one end of the upper developer housing chamber 53*a* and the lower developer housing chamber 53*b* in the shaft direction, a toner supply section 58 is disposed. The toner supply section 58 is constituted by an upper toner supply part 58A that is disposed on the surface of one end of the upper developer housing chamber 53*a* in the shaft direction and a lower toner supply part 58B that is disposed on the surface of one end of the lower developer housing chamber 53*b* in the shaft direction. On the upper side of the upper toner supply part 58A, a toner supply opening 58*a* is formed. The upper toner supply section 58A and the lower toner supply section 58B are partitioned by a partition wall W2, and an opening 58*c* as an example of a toner transport section according to this embodiment is formed therein for transporting toner. When the toner density inside the developer housing chambers 53*a* and 53*b* is determined to be lower than a predetermined density range due to a developing reaction or the like, for example, based on the result of detection of a density sensor Sd disposed on a lower side of the lower developer housing chamber 53*b* on the downstream side in the developer conveying direction, toner is supplied from the toner cartridge 10 to the toner supply section 58 through the toner supply opening 58*a*. Then, after the supplied toner is transported from the upper toner supply part 58A to the lower toner supply part 58B through the opening portion 58*c* that is disposed in a position overlapped with the toner supply opening in the shaft direction, the toner is configured to be supplied inside the lower developer housing chamber 53*b*. According to this embodiment, the two-component developer includes toner and a carrier.

According to this embodiment, both the supply auger 56 and the admix auger 57 circulate and convey the developer housed in the developer housing chambers 53*a* and 53*b* and agitate and convey the supplemental toner inside the toner supply section 58. The supply auger 56 and the admix auger 57 are formed as rotation members 56 and 57 of a shaft extending over the developer housing chambers 53*a* and 53*b* and the toner supply section 58 in the shaft direction. In particular, the supply auger 56 is inserted into a through hole not shown in the figure which is disposed on a side wall adjacent to the upper developer housing chamber 53*a* and the upper toner supply part 58A, and the rotation shaft 56*a* thereof is supported to be rotatable through a bearing section not shown in the figure on side walls of the upper developer housing chamber 53*a* and the upper toner supply part 58A in both end portions in the shaft direction. Similarly, the admix auger 57 is inserted into a through hole not shown in the figure which is disposed on a side wall adjacent to the lower developer housing chamber 53*a* and the lower toner supply part 58B, and the rotation shaft 57*a* thereof is supported to be rotatable through a bearing section not shown in the figure on side walls of the lower developer housing chamber 53*b* and the lower toner supply part 58B in both end portions in the shaft direction.

According to this embodiment, in a portion of the supply auger 56 which corresponds to the inside of the upper developer housing section 53*a*, a spiral-shaped blade 56*b* that agitates and conveys the two-component developer in a predetermined shaft direction (in FIG. 3, from the right side to the left side) is formed on a periphery of the rotation shaft 56*a*.

In addition, in a portion of the admix auger 57 which corresponds to the inside of the lower developer housing section 53*b*, a spiral-shaped blade 57*b* for agitating and conveying the two-component developer in a direction opposite to the supply auger 56 (in FIG. 3, from the left side to the right side) is formed on a periphery of the rotation shaft 57*a*.

The supply auger 56 corresponding to the inside of the upper developer housing chamber 53*a* and the admix auger 57 corresponding to the inside of the lower developer housing chamber 53*b* are partitioned by a partition wall W. In addition, by opening both end portions of the partition wall W in the shaft direction (longitudinal direction), the upper developer housing chamber 53*a* and the lower developer housing chamber 53*b* communicate with each other. In particular, in one end portions of the developer housing chambers 53*a* and 53*b* in the shaft direction on the toner supply section 58 side, a downward developer communication hole 53D that enables the developer to move downward from the upper developer housing chamber 53*a* to the lower developer housing chamber 53*b* and the upper and lower developer housing chambers 53*a* and 53*b* to communicate with each other is formed. In addition, in the other end portions of the developer housing chambers 53*a* and 53*b* in the shaft direction, an upward developer communication hole 53U that enables the developer to move upward from the lower developer housing chamber 53*b* to the upper developer housing chamber 53*a* and the upper and lower developer housing chambers 53*a* and 53*b* to communicate with each other is formed. Accordingly, a developer circulating and conveying path through which the two-component developer is circulated and conveyed in a predetermined direction (in FIG. 3, a counterclockwise direction represented by an arrow) is formed.

In this embodiment, the rotation direction of the admix auger 57 is set to a rotation direction (in FIG. 2, the clockwise direction) passing through the lower side, the partition wall, and the upper wall in the mentioned order. By this rotation, the developer conveyed by the spiral-shaped blade 56*b* formed in the admix auger 57 is pumped up to the partition wall side, and accordingly, the developer is transported to the supply auger 56 disposed inside the developer housing chamber 53*a* through the upward developer communication hole 53U. Similarly, the rotation direction of the supply auger 56 is set to a rotation direction (in FIG. 2, the clockwise direction) passing through the lower side, the developing roll 52, and the upper wall in the mentioned order. Accordingly, the supply auger 56 pumps up the developer to be conveyed to the developing roll 52 side, and accordingly, the developer is supplied from the supply auger 56 to the developing roll 52.

In the developing device according to this embodiment, on the downstream side of the supply auger 56 along the developer conveying direction (a white arrow shown in FIG. 4) relative to the downward developer communication hole 53D and on the upstream side relative to the toner supply opening 58*a*, a developer discharge opening 58*b* (see FIGS. 3 and 4) is disposed below the supply auger 56 extending inside the toner supply section 58, and so-called a trickle method in which deteriorated two-component developer is slowly discharged is used.

With regard to the supply auger 56 and the admix auger 57 corresponding to the inside of the toner supply section 58, a partition wall W2 is disposed between the supply auger 56 and the admix auger 57 in an area from a side wall adjacent to the developer housing chambers 53*a* and 53*b* and the toner supply section 58 to the developer discharge opening 58*b*. Accordingly, the flow of the discharged developer conveyed to the developer discharge opening 58*b* is prevented from being mixed with the supplemental toner in advance.

However, as described above, in a developing device in which the heights of the developer housing chambers 53*a* and 53*b* are differently disposed, generally, the developer is needed to be pumped up from the lower developer housing chamber 53*b* to the upper developer housing chamber 53*a*, and accordingly, the rotation direction of the admix auger 57 is regulated (in this example, the clockwise direction in FIG. 2). In addition, since the supply auger 56 is needed to rotate so as to supply (move the toner to be close to the developing roll 52 side) the toner to the developing roll 52 side, similarly, the rotation direction thereof is regulated (in this example, the clockwise direction in FIG. 2). When the supply auger 56 and the admix auger 57 are also used for agitating and conveying the supplemental toner as described above, the supply auger 56 rotates (see FIG. 2) such that toner located between the supply auger 56 and the admix auger 57 approaches the developing roll 52 side, near the toner supply opening 58*a*, and accordingly, it is difficult to transport the toner supplied from the upper direction of the supply auger 56 to the admix auger 57. In addition, since the admix auger 57 rotates (see FIG. 2) such that the toner approaches (toner is pumped up) the supply auger 56 side, a wall of toner is formed in an opening portion 58*c* between the upper toner supply part 58A and the lower toner supply part 58B due to the supplied toner pumped up by the admix auger 57. In particular, the wall of toner blocks smooth supply of toner from the upper toner supply part 58A to the lower toner supply part 58B through the opening portion 58*c* in the toner supply section 58.

Figure 4:
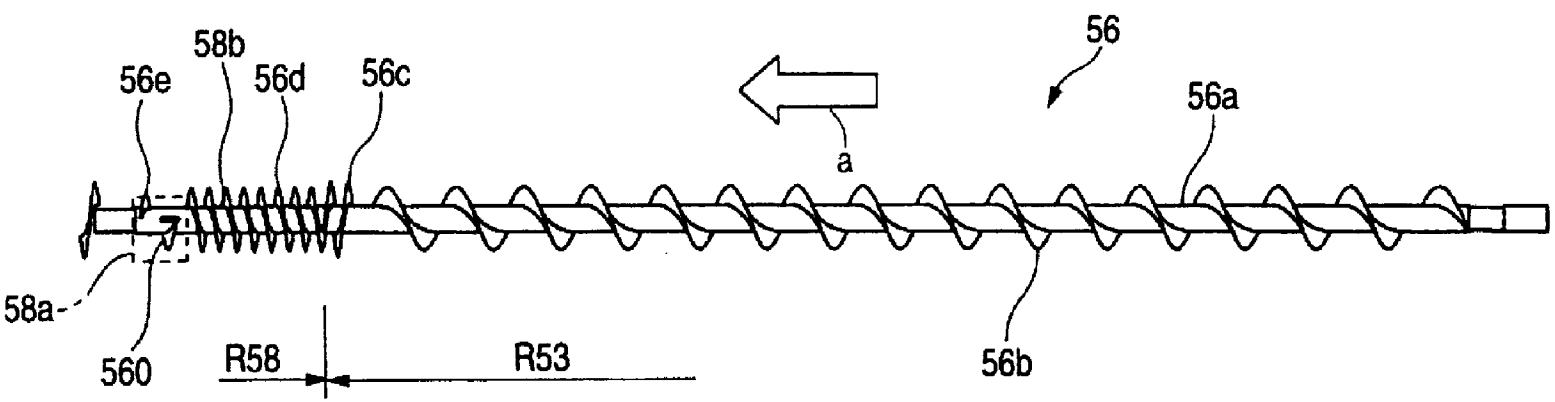
FIG. 4 is a schematic diagram for describing the configuration of an agitating and conveying member according to an embodiment of the present invention.
Figure 5:
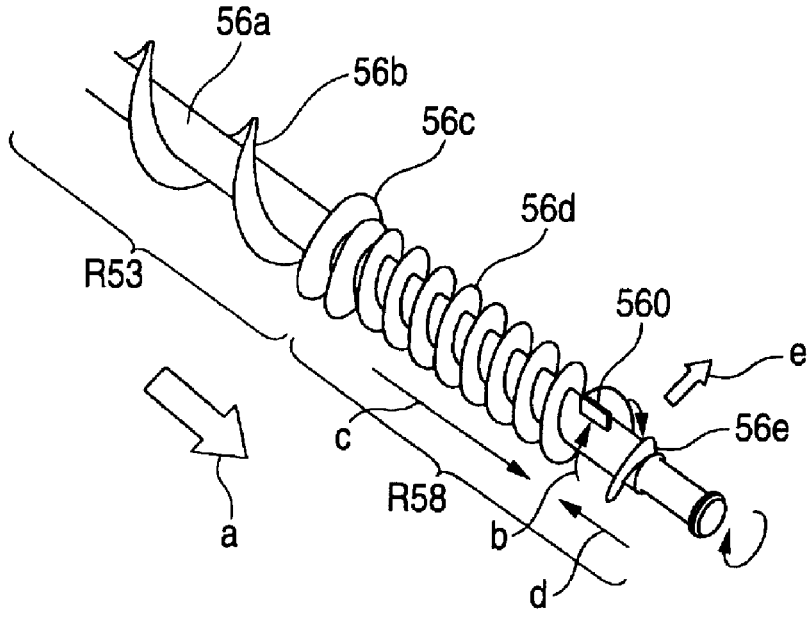
FIG. 5 is an enlarged schematic diagram enlarging a part of FIG. 4.

Next, the supply auger 56 as an example of an upper conveying section according to an embodiment of the present invention will be described in detail with reference to FIGS. 4 and 5. Here, FIG. 4 is a schematic diagram showing the configuration of the supply auger. FIG. 5 is an enlarged schematic diagram showing an enlarged shaft-end portion on the toner supply opening side in FIG. 4.

As shown in FIGS. 4 and 5, the supply auger 56 has a spiral-shaped agitating and conveying blade 56*b*, as an example of a first conveying member according to this embodiment, which is formed on the periphery of the rotation shaft 56*a* in an area R53 corresponding to the inside of the upper developer housing chamber 53*a* and a spiral-shaped regulation bald 56*c* formed on the periphery of the rotation shaft 56*a* in a direction opposite to that of the agitating and conveying blade 56*b* in an end portion in the shaft direction approaching the surface of the side wall of the upper developer housing chamber 53*a* on the downstream side in the developer conveying direction (white arrow a in FIG. 5). The supply auger 56 is configured to agitate and convey the developer in a predetermined shaft direction by using the spiral-shaped agitating and conveying blade 56*b* and regulate the amount of discharge of the developer into the developer discharge opening 58*b* disposed on the downstream side by using the regulation blade 56*c*.

In a portion from the end portion on the upper stream to the developer discharge opening 58*b* inside an area R58 corresponding to the inside of the toner supply section 58 of the supply auger 56, a spiral-shaped discharging and conveying blade 56*d*, as an example of a third conveying member according to this embodiment, which has diameter smaller than that of the agitating and conveying blade 56*b* and is formed on the periphery of the rotation shaft 56*a* in the same direction as the agitating and conveying blade 56*b* is formed, so that discharged developer regulated by the regulation blade 56*c* can be discharged to the developer discharge opening 58*b*.

In addition, in a portion inside the area R58 of the supply auger 56 corresponding to the opening portion 58*c* and the toner supply opening 58*a*, a flat plate section 560 that is an example of a diameter direction conveying section according to this embodiment and has a flat plate shape extending along the shaft direction on the upstream side of the area is attached to the rotation shaft 56*a*. In this embodiment, an area corresponding to the toner transport section indicates a position in which the opening portion 58*c* and the spiral shaped supply auger 56 face with each other in the shaft direction of the rotation shaft 56*a* of the upper conveying section. Since toner disposed between the supply auger 56 and the admix auger 57 is agitated in the diameter direction (arrow b in FIG. 5), the wall of toner formed on the opening portion 58*c* side of the lower toner supply part 58B can be released by the flat plate section 560. In addition, since a conveying force in the diameter direction is directly applied to the toner supplied from the toner supply opening 58*a*, the supplied toner can be smoothly transported to the admix auger 57 side (white arrow e in the figure). Here, in this embodiment, the flat plate section 560 applies the conveying force in the diameter direction to the supplemental toner, and accordingly, a conveying force in the shaft direction is reduced. In addition, in order to suppress stay of the toner near the toner supply opening 58*a*, the flat plate section 560 is disposed in a partial area (upstream side) of the opening portion area in the shaft direction instead of being disposed over the entire opening area of the toner supply opening 58*a* in the shaft direction.

In addition, on the downstream side of the flat plate section 560 of an area corresponding to the toner supply opening 58*a*, a spiral-shaped terminal blade 56*e* that is wound on the periphery of the rotation shaft 56*a* in a direction opposite to the discharging and conveying blade 56*d* as an example of a second conveying member according to this embodiment is formed. In particular, the terminal blade 56*e* is disposed to have a distance (gap) from the flat plate section 560 in the shaft direction so as to form a flow path in the diameter direction between the flat plate section 560 having the flat plate shape and the terminal blade. The terminal blade 56*e* has a function of a stopper preventing the supplied toner from being pushed into an end portion of the toner supply section 58 in the shaft direction to fill up the bearing section of the agitating and conveying blade 56*b* or to incur toner aggregation.

As described above, by preparing a distance between the flat plate section 560 and the terminal blade 56*e* in the shaft direction, a flow path in the diameter direction is formed between the flat plate section 560 and the terminal blade 56*e* which have operations for staying the developer. By applying a conveying force (arrow d in FIG. 5) in a direction opposite to the discharging and conveying blade 56*d* by using the terminal blade 56*e*, a conveying force (arrow c in FIG. 5) of the discharging and conveying blade 56*d* in the shaft direction is applied, and toner supplied from the toner supply opening 58*a* is indirectly led to a flow path (gap) in the diameter direction which is formed between the flat plate section 560 having the flat plate shape and the terminal blade 56*e*, and thereby smooth transport of the supplemental toner to the admix auger 57 side (white arrow e in the figure) is promoted.

The flat plate section 560 may be formed as a film-shaped blade having flexibility. However, in view of releasing the wall of toner formed between the supply auger 56 and the admix auger 57 more assuredly, it is preferable that the flat plate section is formed as a flat plate-shaped blade having rigidity.

In addition, in view of preventing blocking a flow path from the toner supply opening 58*a* or the supply auger 56 to the admix auger 57 in the diameter direction by the flat plate section 560 in a case where the flat plate section 560 is rotated, in advance, it is preferable that the rotation radius of the flat plate section 560 is set to be rotated without contacting adjacent wall sides.

In addition, since an angle between the discharging and conveying blade 56*d* and a direction perpendicular to the rotation shaft is formed to be smaller than an angle formed between the terminal blade 56*e* and the direction perpendicular to the rotation shaft, the conveying force in the shaft direction of the rotation shaft is weak. Accordingly, when the developer conveyed from the agitating and conveying blade 56*b* to the discharging and conveying blade 56*d* is moved between the discharging and conveying blade 56*d* and the terminal blade 56*e*, conveying of the developer to the terminal blade 56*e* side can be suppressed owing to a difference between the conveying forces of the discharging and conveying blade 56*d* and the terminal blade 56*e*.

Figure 6:
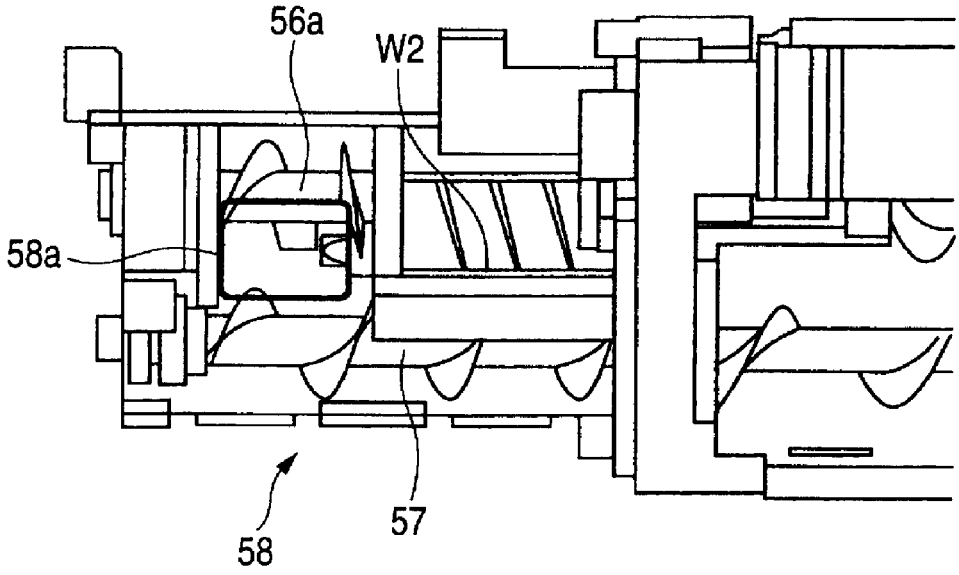
FIG. 6 is a schematic diagram showing a modified example of a position of an opening of a toner supply opening according to an embodiment of the present invention.

In addition, according to this embodiment, the toner supply opening 58*a* may be formed as an opening on the upper side of the supply auger 56. However, as shown in FIG. 6, the toner supply opening 58*a* may be formed to be close to the admix auger 57 side in the diameter direction relative to the shaft center of the rotation shaft 56*a* of the supply auger 56. As described above, when the toner supply opening 58*a* is formed as an opening close to the admix auger 57 side, it is possible to release the wall of toner formed between the supply auger 56 and the admix auger 57 due to fall of the supplied toner more effectively by using a gravitational force.

[Toner Supply Device]

Figure 7A:
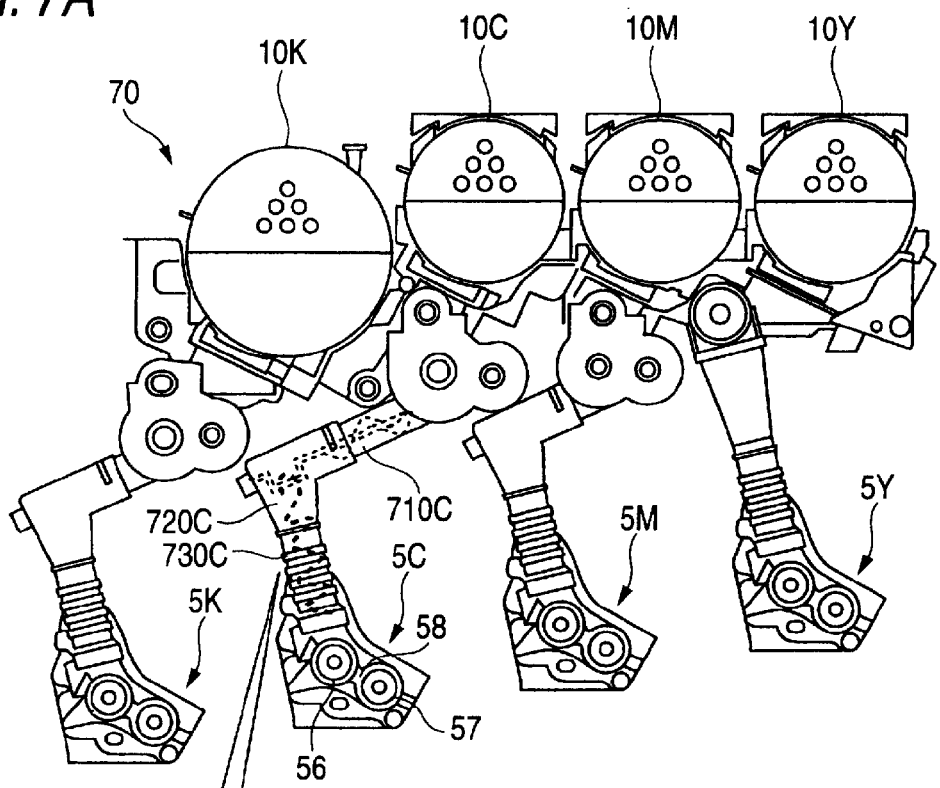
FIGS. 7A to 7C are schematic diagrams showing a toner supply device appropriate to a developing device according to an embodiment of the present invention and the configurations of constituent members thereof.
Figure 7B:
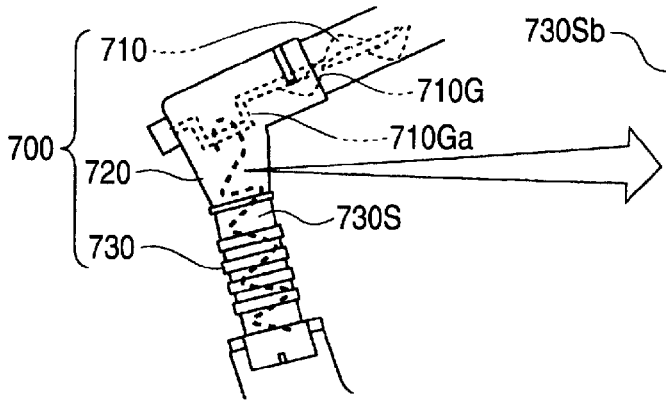
Figure 7C:
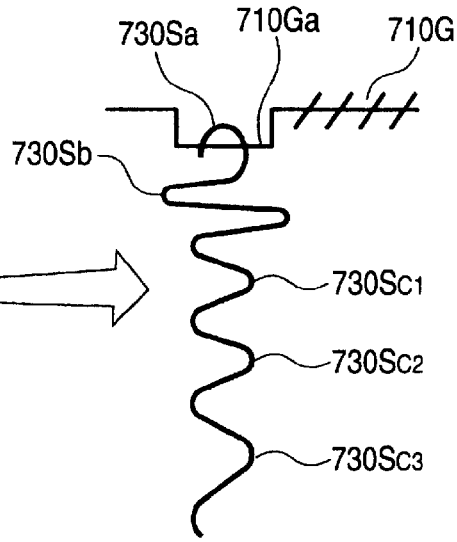

Next, an overview of a toner supply device appropriate to a developing device according to an embodiment of the present invention will be described below with reference to FIGS. 7A to 7C. Here, FIGS. 7A to 7C are schematic diagrams showing the configuration of the toner supply device. FIG. 7A is a schematic diagram showing a state that the toner supply device is attached to the developing device, FIG. 7B is an enlarged schematic diagram showing an enlarged toner conveying path, and FIG. 7C is an enlarged schematic diagram showing an enlarged spring agitator. Since the configurations of toner supply devices 70Y, 70M, 70C, and 70K are basically the same, hereinafter, a reference numeral will be represented as a common representation (for example, the toner supply device 70).

As shown in FIGS. 7A and 7B, the toner supply device 70 according to this embodiment has a toner cartridge 10 and a toner conveying path 700 formed in the shape of an approximate letter "L". A lower end portion of the toner conveying path 700 is connected to the toner supply section 58 of the developing device 5 through the toner supply opening 58*a*. As shown in FIG. 7B, the toner conveying path 700 includes a horizontal tilted conveying path 710 in the shape of an approximate cylinder, a connection section 720 in the shape of an approximate letter "L" having one end connected to a front end portion of the horizontal tilted conveying path 710, and a vertical tilted conveying path 730 connected to the other end portion of the connection section 720 and disposed along an approximately vertical direction.

The horizontal tilted conveying path 710 is formed in the shape of an approximate cylinder. Inside the horizontal tilted conveying path 710, an auger 710G formed by integrally forming a spiral-shaped conveying blade on the outer circumference of the rotation shaft is disposed to be rotatable. The auger 710G is configured to be driven to be rotated by a predetermined amount at a predetermined timing by a driving motor (not shown) disposed in one end portion of the rotation shaft for conveying the toner supplied from the toner cartridge 10 in a predetermined direction.

The connection section 720 is formed in the shape of an approximate letter "L". One end of the connection section 720 has a connection part 720*a* fitted to the front end portion of the horizontal tilted conveying path 710 in the shape of an approximate cylinder. In addition, the other end thereof is formed in the shape of an approximate cylinder having its diameter decreasing toward the lower side in an approximate vertical direction, and has a connection part 720*b* fitted to the upper end portion of the vertical tilted conveying path 730 which has a shape of an approximate cylinder.

The vertical tilted conveying path 730 has an upper end portion formed to have a largest diameter, similar to the shape of the outer surface of the connection part 720*b* of the connection section 720 and is formed in the shape of an approximate cylinder. Inside the vertical tilted conveying path 730, a spring agitator 730S that is a conveying member formed in the shape of a coil by using a metal line or the like is disposed.

In addition, the auger 710G disposed inside the horizontal tilted conveying path 710 extends over the connection section 720, has a crank section 710Ga on its front end, and is supported by a side wall of the connection section 720. In addition, as schematically shown in FIG. 7C, to the crank section 710Ga of the auger 710G, a spring agitator 730S is connected in a state that the hook section 730Sa of the spring agitator 730S curved in the shape of an approximate circle is inserted into and passed through the crank section. When the auger 710G is rotated, the spring agitator 730S is configured to move vertically inside the vertical tilted conveying path 730.

In this embodiment, the spring agitator 730S, as shown in FIG. 7C, is formed to have a winding diameter of the spring 730Sb of an end portion on the hook section 730Sa side larger than that of any other portion 730Sc. In addition, the pitch of the spring 730Sb of the end portion on the hook section 730Sa side is formed to be smaller than that of any other portion. In addition, the spring agitator 730S is configured to has a pitch widened toward the lower side (for example, a pitch between 730$Sc_1$ and 730$Sc_2$<a pitch between 730$Sc_2$, 730$Sc_3$). In addition, the spring agitator 730S is disposed to be brought into contact with the wall side of the vertical tilted conveying path 730 at least in a part thereof.

In the toner supply device having the above-described configuration, toner supplied from the toner cartridge 10, first, is supplied inside the horizontal tilted conveying path 710. The toner supplied inside the horizontal tilted conveying path 710 is conveyed along the longitudinal direction of the horizontal tilted conveying path 710 by driving the auger 710G to be rotated which is disposed to be rotatable inside the horizontal tilted conveying path 710 by a predetermined amount. The toner conveyed along the longitudinal direction of the horizontal tilted conveying path 710 is supplied in a dropped state inside the vertical tilted conveying path 730 disposed along an approximate vertical direction from the front end portion of the horizontal tilted conveying path 710. In addition, the toner supplied inside the vertical tilted conveying path 730 falls downward due to its weight and is supplied to the toner supply section 58 of the developing device 5 through the toner supply opening 58*a*.

At this moment, inside the vertical tilted conveying path 730, a spring agitator 730S is disposed, and the upper end portion of the spring agitator 730S is connected to the crank section 710Ga of the auger 710G disposed to be rotatable inside the horizontal tilted conveying path 710. Accordingly, when the auger 710G inside the horizontal tilted conveying path 710 is driven to be rotated, the spring agitator 730S connected to the crank section 710Ga of the auger 710G moves vertically with a predetermined stroke. Accordingly, the toner naturally falling inside the vertical conveying path 730 is prevented from being attached to the wall side of the vertical tilted conveying path 730 by the spring agitator 730S moving vertically with a predetermined stroke, and the toner can be supplied to the developing device 5 assuredly.

By setting the diameter of the spring 730*sa* of the spring agitator 730S disposed inside the connection section 720 to be larger than that of any other portion and setting the pitch of the spring 730*sa* to be smaller than that of any other portion, it is possible to scrape out the accumulated toner inside the connection section 720, to which the toner can be easily attached and accumulated due to shift of the conveying direction from a horizontal direction to a vertical direction, in an effective manner. In addition, since the pitch is configured to be widened toward the lower side in the direction of gravitation, the toner conveying force on the downstream side increases without blocking the flow of the toner falling in the gravitational direction, and thereby clogging of the toner inside the toner conveying path can be prevented in advance. In addition, the spring agitator 730S is partially brought into contact with the inner wall side of the vertical tilted conveying path 730 to provide vibration, stay of the toner inside the conveying path can be effectively prevented, and attachment of the toner to the spring agitator 730S can be prevented.

Although the above-described embodiments (detailed examples) may be performed individually, it is apparent that the embodiments may be appropriately combined and performed.

What is claimed is:

1. A developing device comprising:

a developer holding member that carries a developer comprising a carrier and a toner;

an upper developer housing section that houses the developer to be supplied to the developer holding member;

a lower developer housing section that is adjacent to the upper developer housing section; has a bottom surface lower than a bottom surface of the upper developer housing section in a direction of gravitational force; and houses the developer to be supplied to the upper developer housing section;

a toner supply section that comprises:

an upper toner supply part that is disposed in one end of a shaft of the upper developer housing section; and defines a toner supply opening on an upper side thereof, the toner being supplied from the toner supply opening into the upper toner supply part;

a lower toner supply part that is disposed in one end of a shaft of the lower developer housing section, which is the same side as the one end of the shaft of the upper developer housing section; and supplies the toner to the lower developer housing section; and a toner transport section that transports the toner from the upper toner supply part to the lower toner supply part;

an upper conveying section that is disposed to extend over the upper developer housing section and the upper toner supply part; and comprises:

a rotation shaft;

a first conveying member that conveys at least one of the developer and the toner in a shaft direction of the rotation shaft;

a second conveying member that is disposed on an end portion on a downstream side in a conveying direction of at least one of the developer and the toner by the first conveying member; and conveys at least one of the developer and the toner in a direction opposite to the conveying direction by the first conveying direction; and a diameter direction conveying part that is disposed in an area corresponding to the toner transport section in the shaft direction of the rotation shaft; and conveys the supplemental toner by applying a conveying force to the supplemental toner, the conveying force being larger in the diameter direction larger than in the shaft direction of the rotation shaft of the upper conveying section;

a lower conveying section that is disposed to extend over the lower developer housing section and the lower toner supply part; rotates such a manner that the lower conveying section passes a bottom side of the lower developer housing section, a side of the upper developer housing section and an upper side of the lower developer housing section in this order; and thereby conveys at least one of the developer and the toner in a direction opposite to the conveying direction by the first conveying member; and a third conveying member that is disposed between the first conveying member and the diameter direction conveying part; conveys the developer in the same direction as the conveying direction by the first conveying member; and has a diameter smaller than the first conveying member.

2. The developing device according to claim 1, wherein the diameter direction conveying part is disposed apart in the shaft direction from a surface for conveying the developer on the downstream side in the conveying direction of the developer by the second conveying member.

3. The developing device according to claim 1, wherein the toner supply section, the toner transport section, and the diameter direction conveying part are overlapped with each other in the shaft direction of the upper conveying section.

4. The developing device according to claim 3, wherein the upper conveying section comprises:

a first area in a position facing the toner supply opening in the shaft direction, in the first area the diameter direction conveying part being disposed and a conveying force that is substantially larger in the diameter direction than in the shaft direction being applied to the developer; and a second area on upstream side from the first area in a position facing the toner supply opening, in the second area the diameter direction conveying part being not disposed and a conveying force substantially larger in the shaft direction than in the diameter direction being applied to the developer.

5. The developing device according to claim 1, wherein the third conveying member that is disposed between the first conveying member and the diameter direction conveying part has a conveying force in the shaft direction of the rotation shaft substantially weaker than that by the second conveying member.

6. The developing device according claim 1, wherein the diameter direction conveying part rotates without contacting the toner supply the upper toner supply part.

7. An image forming apparatus comprising:

an electrostatic latent image carrier that carries an electrostatic latent image on a surface thereof;

the developing device according to claim 1 that develops the electrostatic latent image to form a toner image; and a transferring unit that transfers the toner image on a recoding sheet.

* * * * *